US007879404B2

(12) United States Patent
Li et al.

(10) Patent No.: US 7,879,404 B2
(45) Date of Patent: Feb. 1, 2011

(54) METHOD OF ENHANCING MOISTURE MANAGEMENT AND PROVIDING NEGATIVE ION PROPERTIES TO FABRIC MATERIALS

(75) Inventors: Yi Li, Hong Kong (CN); Junyan Hu, Hong Kong (CN); Qingwen Song, Hong Kong (HK); Yong Fan Mao, Hong Kong (HK)

(73) Assignee: The Hong Kong Polytechnic University, Hung Hom, Kowloon (HK)

( * ) Notice: Subject to any disclaimer, the term of this patent is extended or adjusted under 35 U.S.C. 154(b) by 223 days.

(21) Appl. No.: 11/785,774

(22) Filed: Apr. 20, 2007

(65) Prior Publication Data

US 2008/0258347 A1 Oct. 23, 2008

(51) Int. Cl.
*B05D 3/02* (2006.01)

(52) U.S. Cl. ..... 427/384; 427/385.5; 427/389.9

(58) Field of Classification Search ..... None
See application file for complete search history.

(56) References Cited

U.S. PATENT DOCUMENTS

| | | | | |
|---|---|---|---|---|
| 4,460,641 | A | 7/1984 | Barer et al. | |
| 5,759,225 | A * | 6/1998 | Tanoshima | 71/24 |
| 5,981,063 | A | 11/1999 | Yokozeki et al. | |
| 6,034,520 | A * | 3/2000 | Sugihara et al. | 324/71.1 |
| 6,402,991 | B1 * | 6/2002 | Itakura et al. | 252/500 |
| 6,499,338 | B2 | 12/2002 | Li et al. | |
| 6,994,913 | B1 | 2/2006 | Niki et al. | |
| 2002/0031572 | A1 * | 3/2002 | Funaki et al. | 426/3 |
| 2003/0131394 | A1 | 7/2003 | Chou | |
| 2005/0188470 | A1 * | 9/2005 | Li et al. | 8/115.51 |
| 2006/0169761 | A1 * | 8/2006 | Mao | 232/39 |
| 2007/0020317 | A1 * | 1/2007 | Yeung | 424/443 |
| 2007/0116775 | A1 * | 5/2007 | Lee | 424/489 |
| 2007/0180599 | A1 * | 8/2007 | Baek et al. | 2/338 |
| 2007/0213646 | A1 * | 9/2007 | Han | 601/57 |
| 2007/0259178 | A1 * | 11/2007 | Lin et al. | 428/379 |
| 2009/0007899 | A1 * | 1/2009 | Dodo | 126/263.02 |

FOREIGN PATENT DOCUMENTS

| | | | |
|---|---|---|---|
| JP | 04-327207 | * | 11/1992 |
| JP | 06-173162 | * | 6/1994 |
| JP | 06-104926 B | * | 12/1994 |
| JP | 2003-236974 | * | 8/2003 |

OTHER PUBLICATIONS

Abstracts and partial machine translation of JP 11-036171, Feb. 1999.*

* cited by examiner

*Primary Examiner*—Erma Cameron

(57) ABSTRACT

The present invention relates to a method of enhancing the negative ion properties of a material and enhance its moisture management properties if necessary. The method of the present invention teaches the determination of the moisture properties of a material, development of a negative ion agent, and the application of that agent to the material, such steps leading to a material possessing negative ion properties and good moisture management.

18 Claims, 4 Drawing Sheets

| | Top Surface | Bottom Surface |
|---|---|---|
| Waiting time (sec) | 2.834 | 3.074 |
| Absorption rate (%/sec) | 66.6851 | 66.4416 |
| Max watted radius (mm) | 25.0 | 25.0 |
| Spreading Speed (mm/sec) | 4.9084 | -47.0572 | 4.6053 |
| One way transport capability | HH7- | |
| Description | | |

| | Top Surface | Bottom Surface |
|---|---|---|
| Waiting time (sec) | 3.796 | 3.155 |
| Absorption rate (%/sec) | 12.3973 | 63.5487 |
| Max watted radius (mm) | 15.0 | 20.0 |
| Spreading Speed (mm/sec) | 3.0608 | 3.9642 |
| One way transport capability | 579.8848 | |
| Description | HHT | |

METHOD OF ENHANCING MOISTURE MANAGEMENT AND PROVIDING NEGATIVE ION PROPERTIES TO FABRIC MATERIALS

BACKGROUND

The behavior of liquid moisture transfer in fabric in multi-dimensions, called fabric moisture management property, is claimed to influence a wearer's comfort perception significantly. Particularly, during high level of physical exercise with a heavy perspiration rate under dressed conditions, the liquid sweat on the skin is mainly absorbed by the worn garment and transferred from the fabric's inner surface to its outer surface where the sweat is evaporated into the environment, or accumulated on the skin surface. Therefore, fabrics with good moisture management properties where the liquid perspiration can easily transfer from a skin surface to a garment's outer surface to maintain a dry feeling are required in the marketing of high value added casual wear, sportswear, or personal protective clothing. With the advantage of material moisture management capacity, most part of liquid sweating can easily be transferred to a soft material's outer surface where it is evaporated. It also can take away more heat energy when compared to the same fabric that lacks moisture management performance. Soft material treated with moisture management performance can also reduce the thermal stress of the wearer during intensive exercise.

Negative ions are odorless, tasteless, and invisible molecules that we inhale in abundance from certain environment. Many people feel energized at the forest, beach, storms, oceans, rivers, and waterfalls, where negative ions concentration and above 1000/cm$^3$. Many people are also uncomfortable in a windowless room and closed, moving vehicles, where the negative ion concentration is around 100/cm$^3$. Thayer in 1996 reported that high concentrations of negative ions are essential for high energy and a positive mood. Diamond (University of California, Berkeley) found that without negative ion in the air you will experience an increase in serotonin, and its attendant drowsiness and relaxation.

U.S. patent application 20030131394 disclosed an application with three layer fabric structure with added negative ions on the middle layer fabric to reduce peoples stress. U.S. Pat. No. 7,105,809 disclosed a way to use negative ion material in material analysis. U.S. Pat. No. 4,244,712 disclosed a way to use negative ion generator to clear room air.

The prior art teaches making fabric with desirable moisture transport properties, including making from a synthetic fiber via knitting (U.S. Pat. No. 6,509,285), a multi-layer structure design (U.S. Pat. No. 6,277,468), and manufacturing products using fabric with moisture management properties (U.S. Pat. No. 5,269,720).

However, the prior art fails to teach a treated fabric to enhance both the fabric moisture management property and negative ion radiation capacity.

It is an object of the present system to overcome the disadvantages and problems in the prior art.

DESCRIPTION

The present invention proposes to provide a method of enhancing the negative ion properties of a material and enhance its moisture management properties if necessary. The method of the present invention teaches the determination of the moisture properties of a material, development of a negative ion agent, and the application of that agent to the material, such steps leading to a material possessing negative ion properties and good moisture management.

It is also a purpose of the invention to provide methods of making material having sufficient negative ion properties and good moisture management in order to allow the manufacture of products that, when used, allow users to feel comfortable and enjoy the beneficial effects of negative ions.

BRIEF DESCRIPTION OF THE DRAWING

These and other features, aspects, and advantages of the apparatus and methods of the present invention will become better understood from the following description, appended claims, and accompanying drawings where:

The following description of certain exemplary embodiment(s) is merely exemplary in nature and is in no way intended to limit the invention, its application, or uses. Throughout this description, the term "soft material", to be used interchangeably with "material", shall refer to articles whose qualities allow them to come into long-term comfortable contact with the skin, including articles that are to be worn, for example exercise equipment, security wear, ancillary sports wear such as headbands and wrist bands, undergarments, socks, gloves, hosiery, hats, caps, and the like. The material can also include items that form part of the articles, such as hat bands. The term can also refer to sheets that come in direct contact with user's skin, pillow cases, and the like. The material can be made of natural fiber for example cotton, hemp, wool, silk, or the like, or synthetic fiber. The material may be elastic, from fitting, or free-flowing. The term "negative ion" shall refer to a mineral that has an electrical potential.

Now, to FIGS. 1-5. Whereas FIGS. 1-5 are presented individually, in total they define the present invention.

Figure 1:
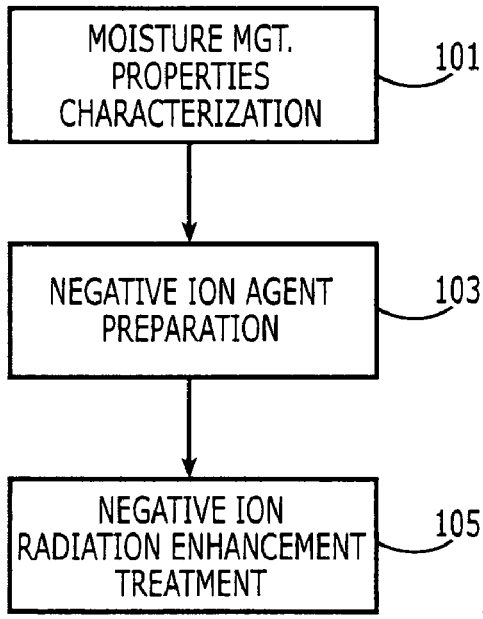
FIG. 1 shows a method of manufacturing material possessing negative ions and good moisture management properties.

FIG. 1 is a method of enhancing a soft material in accordance with present invention, including the steps of characterizing moisture management properties 101 of the material, preparing a negative ion agent 103, and treating the material with negative ion radiation enhancement 105.

Characterizing moisture management properties for a soft material 101 can occur in accordance with U.S. Pat. No. 6,499,338 (*338), incorporated herein by reference, using methods and systems as taught therein. As shown in *338, characterizing moisture management can occur using a water guide pipe, and a pair of opposing plates, each plate including an array of concentric electrical conductors and a textile fabric. The textile fabric is positioned between and held by the plates for testing and in position by a central conductor pin. Moisture management capacity of the textile, which indicates the textiles capability of quick liquid absorbency, one-way moisture transport, and quick dry, is defined as:

$$\text{OMMC}=C_1*AR_{B_ndv}+C_2*R_{ndv}+C_3*SS_{B_ndv},$$

where $C_1$, $C_2$ and $C_3$ are weights applied to the non-dimension values: $AR_{B_ndv}$, $R_{ndv}$ and $SS_{B_ndv}$ of the indices of the average absorption rate ($AR_B$), one-way transport index (R) and spreading speed ($SS_B$). These are defined as follows:

$$AR_{B_ndv} = \begin{cases} 1, & AR_B \geq AR_{B_max} \\ \dfrac{AR_B - AR_{B_min}}{AR_{B_max} - AR_{B_min}}, & AR_B \in [AR_{B_min}, AR_{B_max}] \\ 0, & AR_B \leq AR_{B_min} \end{cases}$$

$$R_{ndv} = \begin{cases} 1, & R \geq R_{max} \\ \dfrac{R - R_{min}}{R_{max} - R_{min}}, & R \in [R_{min}, R_{max}] \\ 0, & R \leq R_{min} \end{cases}$$

$$SS_{B_ndv} = \begin{cases} 1, & SS_B \geq SS_{B_max} \\ \dfrac{SS_B - SS_{B_min}}{SS_{B_max} - SS_{B_min}}, & SS_B \in [SS_{B_min}, SS_{B_max}] \\ 0, & SS_B \leq SS_{B_min} \end{cases}$$

And $OMMC \in [0, 1]$.

$AR_{B_max}$, $AR_{B_min}$, $R_{max}$, $R_{min}$, $SS_{B_max}$ and $SS_{B_min}$ are the constants of the setting maximum and minimum limits of $AR_B$, R and $SS_B$ respectively, and they are determined by the first and the last grading values in the grading table or grading configuration file for each index.

$C_1$, $C_2$ and $C_3$ can be adjusted according to the relative importance of the three indexes in the situation where the final products are used. For example, if the test fabrics are going to be for cycling wear in a humid environment, one way transport of liquid sweat is very important for keeping the skin dry. In a humid environment, the evaporation of liquid water is relatively slow, so that the absorption rate and spreading speed are less important. Therefore, we can set: $C_1$=0.25, $C_2$=0.5 and $C_3$=0.25. The larger the OMMC (overall moisture management capacity), the higher the overall moisture management capability of the textile. The plates can be arranged to be adjustable in order to apply different processes to the material.

Characterizing the moisture management property 101 for the material allows a determination of if the material is a good candidate for applying the negative ion agent. For example, with four OMMC valves of 7.14, 0.17, −0.77, and −0.64 calculated for four fabric materials (Nos. 1, 2, 3, and 4, respectively), it can be determined that fabric No. 1 is the best, fabric Nos. 3 and 4 show no one way transport capability, and fabric Nos. 3 and 4 show poor drying behaviour. The characterization also allows a determination of which materials may be good candidates for moisture management enhancement treatment, as will be discussed later.

Preparing the negative ion agent 103 can include the steps of mixing a negative ion mineral with one or more hydrophilic binder, one or more anionic dispersing agent, one or more thickener, and one or more hydrophilic agent.

Examples of suitable negative ion minerals for use herein can include tourmaline, monazite, heluguson, opal, charcoal, and mixtures of such minerals. The amount of negative ion mineral included in the negative ion agent 103 can be about 20 to about 100 g/L. In one embodiment, the amount of negative ion mineral is approximately 55-65 g/L, with a preferred embodiment of 60 g/L. The negative ion mineral can also contain element such as zirconium, neodymium, cerion, silver, phosphor, oxygen, silicon, alumina, and boron oxide. The negative ion mineral may be pulverized such that the particle size can be about 1 to about 4 μm. In one embodiment, pulverization is obtained by using a ultrasonic crusher. The shape of the particle can be rounded, circular, irregular, or other similar shape.

Hydrophilic binding agent can include Styrene polymers, Carboxylated styrene-butadiene latex, Styrene-butadiene, Acrylic copolymer, Ethylene vinyl acetate, Poly(methylate-co butylmethacrylate), Polyvinyl Acetate homopolymers, 2-styrene-acrylic emulsion polymers, Styrene-acrylic copolymers, Styrene-vinyl copolymers, and Vinyl acetate copolymers, or mixtures thereof. The amount hydrophilic binding agent can be from about 0 to about 30 g/L. In one embodiment, about 8 to about 12 g/L of hydrophilic binding agent is included in the negative ion agent, with a preferred embodiment of 10 g/L.

Dispersing agents can include Fatty alcohol/ethylene oxide condensate, Sodium Alkyl benzene sulfonate, Fatty acid ester, Naphthalene sulfonate, Fatty acid alkanolamine, Sulphonated amide, Ammonium Laureth Sulfate, Sodium Lauryl Sulfate, or mixtures thereof. The amount of dispersing agent in the negative ion agent can be from about 3 to about 10 g/L. In one embodiment, the amount of dispersing agent is about 2 to about 6 g/L. with a preferred embodiment of 4 g/L.

Thickener used in the negative ion agent Acrylic copolymer dispersion, sodium alginate, kerosene/MTO(Mineral Turpentine Oil), polysaccharide, starch based thickener, alginate based copolymers and propane-diol alginate, or mixtures thereof. The amount of thickener can be from about 1 to about 60 g/L. In one embodiment, the amount of thickener is about 8 to about 120 g/L, with a preferred embodiment of 10 g/L.

The hydrophilic agent used in the negative ion agent can be, but is not limited: Octylphenol ethoxylate, Nonylphenol ethoxylate, Ethylene oxide/propylene oxide copolymer, Alkoxylates, Fatty alcohol ethoxylate, fatty acid esters, naphthalene sulfonate, fatty acid alkanolamine, sulphonated amide, Ammonium Laureth Sulfate, Sodium Lauryl Sulfate, and mixtures thereof. The amount of hydrophilic agent can be from about 1 to about 60 g/L. In one embodiment, the amount of hydrophilic agent is about 8 to about 12 g/L, with a preferred embodiment of 10 g/L.

Treating the material with negative ion radiation 105 can consist of applying the negative ion agent to the material. Application can be by physiochemical methods, such as coating which includes direct, indirect, or transfer coating. Examples of direct coating include doctor blading, roll coating, and rotary screen coating. Other suitable coating techniques include extrusion coating, melt calendar coating, powder coating, cost coating, foam coating, spray coating, curtain coating and rod coating. Other physiochemical methods for applying the negative ion agent include alteration of the fiber surface by high energy, insolubilization or deposition, and microencapsulation. In microencapsulation, the negative ion agent may be encapsulated and then the microcapsule can be affixed to the material.

Chemical methods may also be employed for applying the negative ion agent, including graft and/or homopolymerization, crosslinking, covalent bore formation, and ion exchange/chelation. In cases, where chemical methods of application are employed, various polymers may be combined with the negative ion agent, such polymers including polyvinyl chloride, polyurethane, polypropylene, polystyrene, polyester, polyamide, polyisoprene, polychloroprene, and the like. In one embodiment, it is possible to combine physiochemical techniques with chemical methods.

Other methods for applying the negative ion agent to the material can be by immersion, such as vat immersion, padding, spraying such as air-atomized spraying, air-assisted spraying, airless spraying, and high volume low pressure spraying.

Application to the material is finalized through drying and curing. Drying can occur by air drying, Mitchell drying, forced air drying, or the like. Alternatively, squeezing of the substrate can be performed through the use of pairs of rolls. In one embodiment, drying occurs from about 75° C. to about 100° C. for approximately 2 to 12 minutes.

The material can be cured through conventional means. In one embodiment, curing occurs from about 110° C. to about 180° C. for between 1 to 5 minutes.

In an alternative embodiment, following step 101, techniques can be applied to the material to improve the moisture abilities, such techniques include using fabric with a different surface energy, employing yarns with specific designed structures, and modifying fabric surface properties during finishing. The moisture management enhancement treatment as taught in Australian Patent Application 2006235897, incorporated herein by reference, may be utilized in the present method.

In an alternative embodiment, washing of the fabric may occur after step of treatment with the negative ion radiation enhancement 105. The washing of the fabric is to remove any unfixed materials on the fabric surface. Washing may occur by soaking in an aqueous solution, agitation in an aqueous solution, and the like.

EXAMPLES

Example 1

Pure cotton knitted fabric material is obtained and evaluated by a moisture management characterization. The performance of material moisture management is classified as grade 5.

A tourmaline negative ion agent prepared in accordance with the present invention, having the formula:

1) Tourmaline (Supplied by Sharp well Ltd.) 30 g/L
2) Binder (Poly(methylate-co butyl methacrylate) 5 g/L
3) Dispersing agent (fatty alcohol alkoxylates and glycol ethers, Americos Industrials Inc) 3 g/L
4) Thickener (propane-diol alginate) 10 g/L In order to increase the durability of treatment, the particle size of negative ion powder is controlled to be averaged at about 2 μm. In a preferred embodiment, the particle size is smaller than 2 μm.

Commercial spraying equipment (T-1800-3200, China) was used to spray the prepared emulsion onto fabric inner surface. Detail manufacturing parameter is speed 4 m/minutes, flow rate 150 g/min, drying temperature 100° C., for 5 minutes and curing temperature is 150° C., for 2 minutes.

Figure 2:
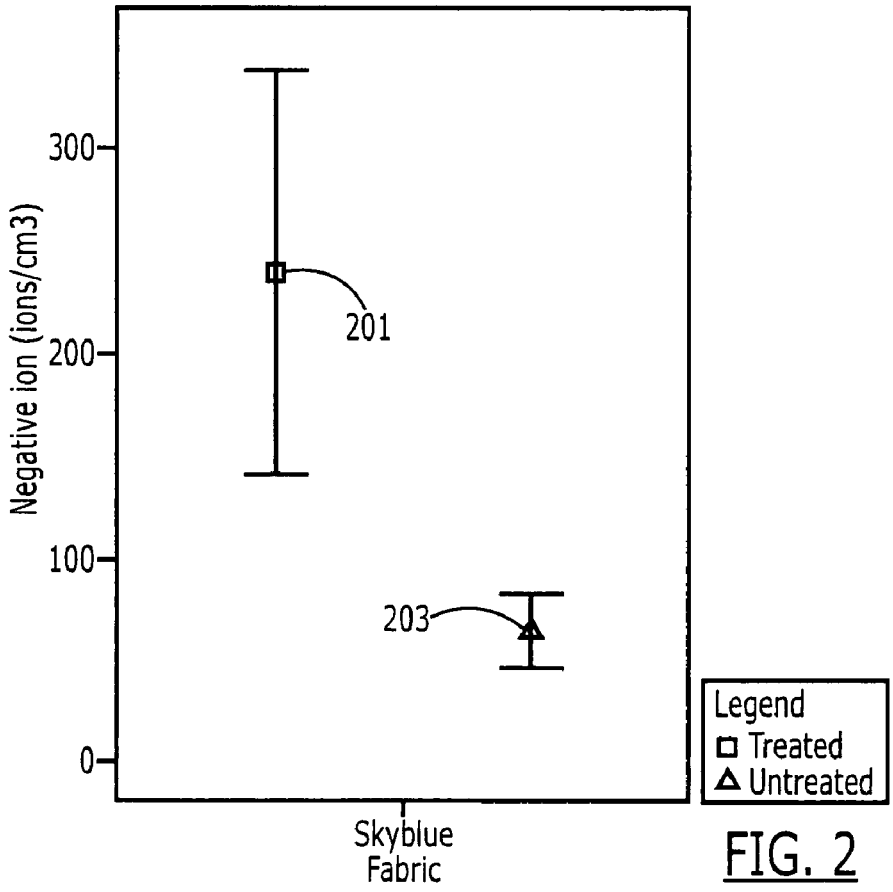
FIG. 2 compares the negative ions of a fabric both before and after treatment.

FIG. 2 shows negative ions results both before treatment 203 and after treatment 201. As shown, the mean value of treated fabric increases to 250 ions/cm$^3$.

Example 2

Coolmax™ polyester woven fabric is purchased from market. Due to the special structure of Coolmax™ fiber, the surface properties of this woven fabric are characterized to show hydrophilic performance.

Figure 3:
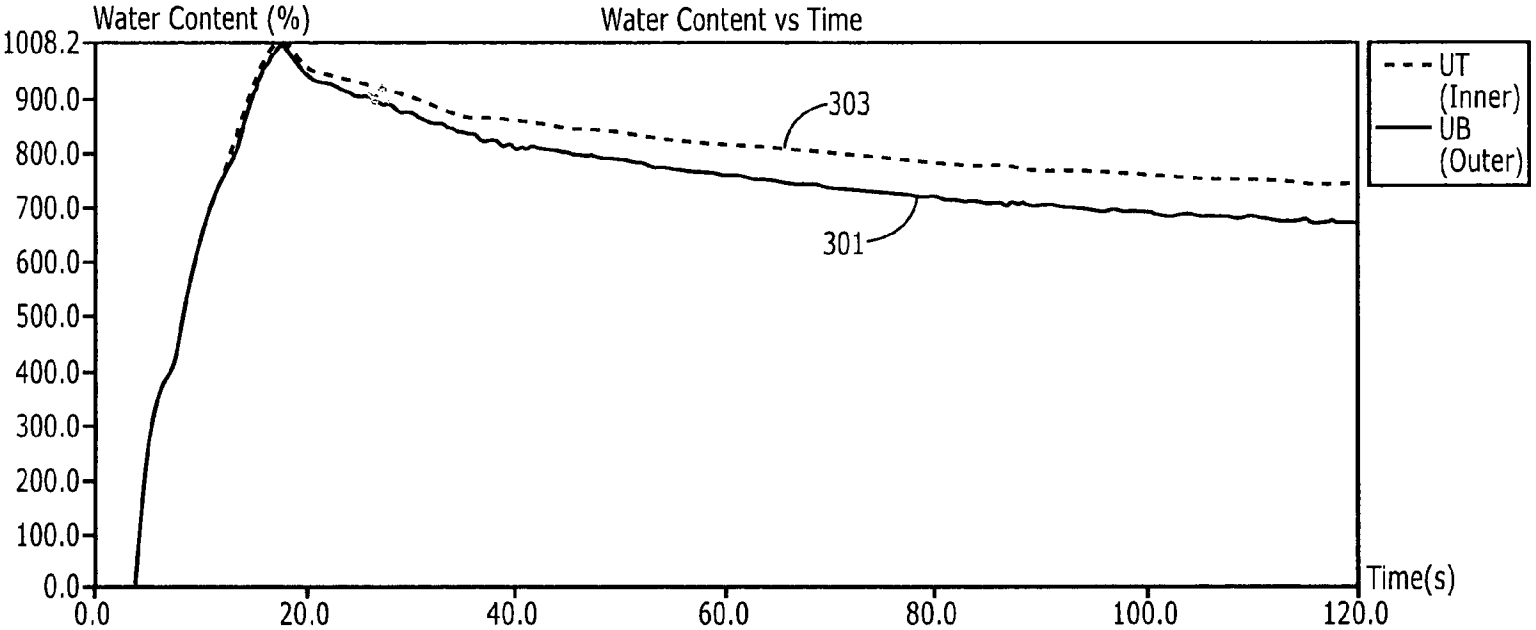
FIG. 3 shows the water content of a fabric (Coolmax™), both inner and bottom.

FIG. 3 shows that a little higher water content on the fabric inner surface (dash line) as compared to the fabric bottom. This indicates that after sweating during wetting, the fabric bottom surfaces are wetted.

Figure 4:
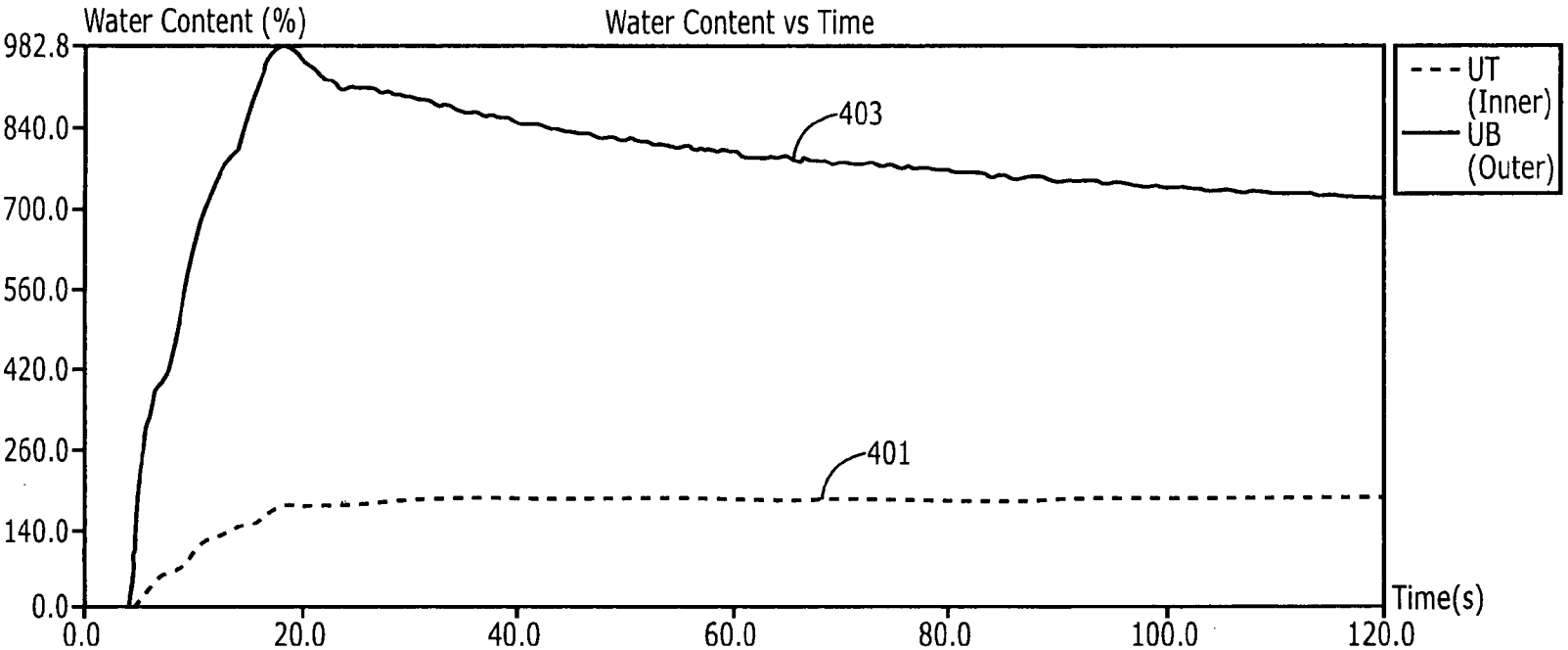
FIG. 4 shows a fabric following moisture management treatment processes.

FIG. 4 shows the Coolmax™ fabric treated using moisture management treatment processes. As shown, the liquid arriving to the fabric top surface is quickly and easily transferred to the fabric bottom surface with the higher water content on the fabric bottom surface. This indicates that after sweating most of liquid will transfer from clothing inner surface to outer surface where it can be evaporated to the environment and keep a dry feeling.

The negative ion agent was prepared in accordance with the present invention, having the recipe:

a) Tourmaline (Supplied by Sharp well Ltd.) 20 g/L
b) Binder (acrylate copolymer dispersion) 5 g/L
c) Dispersing agent (Tween0-80) 10 g/L
d) Thickener (acetylated starch) 5 g/L
e) Hydrophilic agent (dioctyl sodium sulphosuccinate) 5 g/L The tourmaline agent is applied to the fabric by dipping the fabric in a solution for 5 minutes and padding, drying the fabric at approximately 100° C. for 3 minutes, and curing at approximately 130° C. for 2 minutes.

Figure 5:
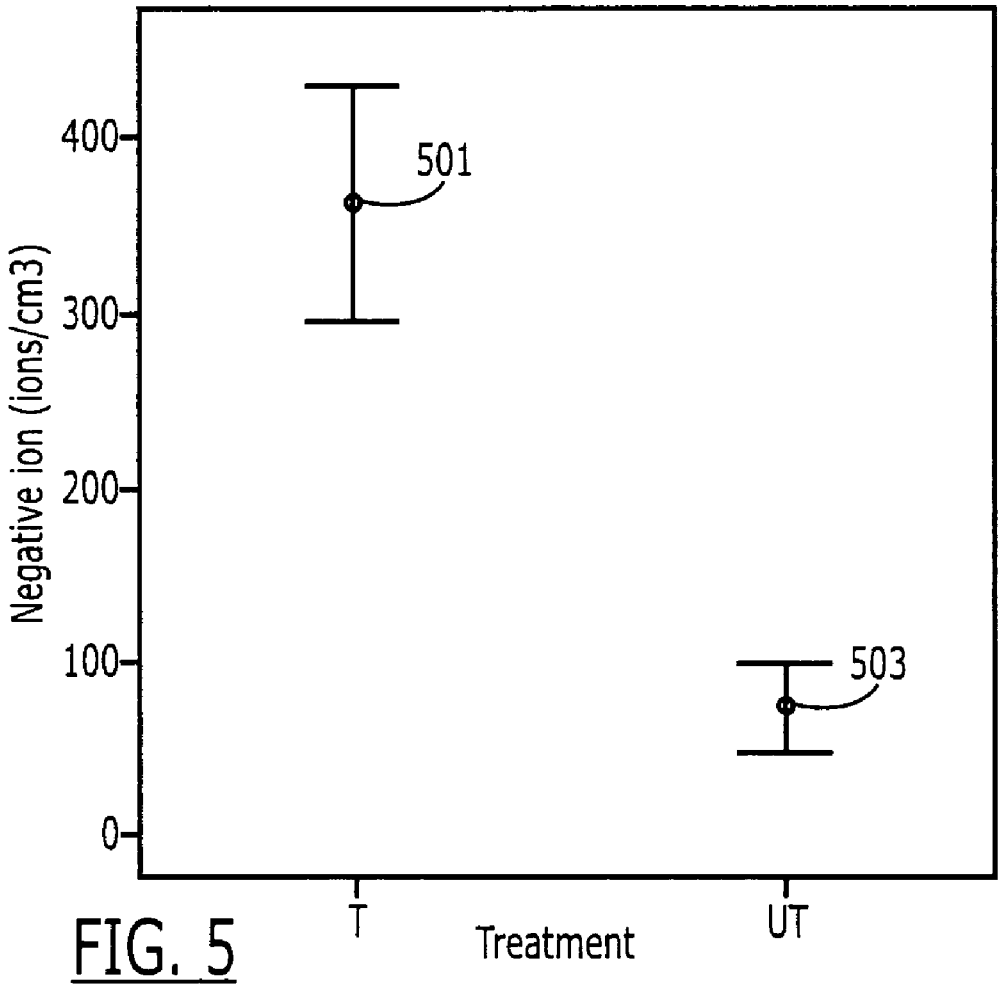
FIG. 5 compares a fabric treated in accordance with the present invention vs. an untreated fabric.

FIG. 5 compares the untreated fabric with the treated fabric in accordance with the above. Compared with the untreated fabric (UT) 503, the original negative ion radiation performance increased from around 80 in/cm$^3$ to around 350 ions/cm$^3$ 501, while material liquid one-way transfer properties increased from about −47 to 570.

Having described embodiments of the present system with reference to the accompanying drawings, it is to be understood that the present system is not limited to the precise embodiments, and that various changes and modifications may be effected therein by one having ordinary skill in the art without departing from the scope or spirit as defined in the appended claims.

In interpreting the appended claims, it should be understood that:

a) the word "comprising" does not exclude the presence of other elements or acts than those listed in the given claim;

b) the word "a" or "an" preceding an element does not exclude the presence of a plurality of such elements;

c) any reference signs in the claims do not limit their scope;

d) any of the disclosed devices or portions thereof may be combined together or separated into further portions unless specifically stated otherwise; and e) no specific sequence of acts or steps is intended to be required unless specifically indicated.

The invention claimed is:

1. A method of preparing a material with one way transport capability and negative ion properties, comprising the steps of characterizing the moisture management properties of said material;

determining whether said material has one way transport capability based on the characterized moisture management properties of said material;

preparing a negative ion agent; and treating said material with said negative ion agent if said material is determined to have one way transport capability, wherein preparing said negative ion agent includes mixing a negative ion mineral with one or more hydrophilic binding agent.

2. The method of claim 1, wherein characterizing the moisture management properties occurs using a water guide pipe, and a pair of opposing plates.

3. The method of claim 1, wherein said material includes articles to be worn.

4. The method of claim 3, wherein said material is a natural fiber or synthetic fiber.

5. The method of claim 4, wherein said material is elastic.

6. The method of claim 1, wherein preparing said negative ion agent further comprises the steps of mixing with one or more anionic dispersing agent, one or more thickener, and one or more hydrophilic agent.

7. The method of claim 6, wherein said negative ion mineral is selected from the group consisting of tourmaline, opal, charcoal, and mixtures thereof, in an amount of about 20 to about 100 g/L.

8. The method of claim 7, wherein said negative ion mineral is present in an amount of 55 to 65 g/L.

9. The method of claim 1, wherein said one or more hydrophilic binding agent is selected from the group consisting of Styrene polymers, Carboxylated styrene-butadiene latex, Styrene-butadiene, Acrylic copolymer, Ethylene vinyl acetate, Poly(methylate-co butyl methacrylate), Polyvinyl Acetate homopolymers, 2-styrene-acrylic emulsion polymers, Styrene-acrylic copolymers, Styrene-vinyl copolymers, and Vinyl acetate copolymers, or mixtures thereof, in the amount of 30 g/L or less.

10. The method of claim 6, wherein said one or more anionic dispersing agent is selected from the group consisting of Fatty alcohol/ethylene oxide condensate, Sodium Alkyl benzene sulfonate, Fatty acid ester, naphthalene sulfonate, Fatty acid alkanolamine, sulphonated amide, Ammonium Laureth Sulfate, Sodium Lauryl Sulfate, or mixtures thereof, in an amount of from about 3 to about 10 g/L.

11. The method of claim 6, wherein said one or more thickener is selected from the group consisting of Acrylic copolymer dispersion, sodium alginate, Kerosene/Mineral Turpentine Oil, polysaccharide, starch based thickener, alginate based copolymers, propane-diol alginate, or mixtures thereof, in an amount of from about 1 to about 60 g/L.

12. The method of claim 6, wherein said one or more hydrophilic agent is selected from the group consisting of Octylphenol ethoxylate, Nonylphenol ethoxylate, Ethylene oxide/propylene oxide copolymer, Alkoxylates, Fatty alcohol ethoxylate, fatty acid esters, naphthalene sulfonate, fatty acid alkanolamine, sulphonated amide, Ammonium Laureth Sulfate, Sodium Lauryl Sulfate, and mixtures thereof, in an amount of from about 1 to about 60 g/L.

13. The method of claim 1, wherein treating said material with said negative ion agent comprises applying said negative ion agent to said material.

14. The method of claim 13, wherein applying said negative ion agent can be by physicochemical, chemical, or physiochemical/chemical methods.

15. The method of claim 13, wherein applying said negative ion agent further comprises the step of drying said material following application between about 75° C. to about 100° C.

16. The method of claim 15, wherein applying said negative ion agent further comprises the step of curing between about 110° C. to about 180° C.

17. The method of claim 16, wherein applying said negative ion agent includes the steps of washing the material.

18. The method of claim 1, wherein the one way transport capability is determined by an Overall Moisture Management Capacity value.

* * * * *